US011486679B1

(12) United States Patent
Adelmann

(10) Patent No.: US 11,486,679 B1
(45) Date of Patent: Nov. 1, 2022

(54) PROTECTIVE SHIELD WITH DISPLAY

(71) Applicant: Todd C. Adelmann, Albuquerque, NM (US)

(72) Inventor: Todd C. Adelmann, Albuquerque, NM (US)

( * ) Notice: Subject to any disclaimer, the term of this patent is extended or adjusted under 35 U.S.C. 154(b) by 0 days.

(21) Appl. No.: 17/327,689

(22) Filed: May 22, 2021

(51) Int. Cl.

| | |
|---|---|
| ***G08B 5/22*** | (2006.01) |
| ***F41H 5/08*** | (2006.01) |
| ***H04H 20/59*** | (2008.01) |
| ***G08B 27/00*** | (2006.01) |
| ***G08B 7/06*** | (2006.01) |
| *G08B 5/36* | (2006.01) |

(52) U.S. Cl.
CPC ..... *F41H 5/08* (2013.01); *G08B 5/226* (2013.01); *G08B 7/06* (2013.01); *G08B 27/001* (2013.01); *H04H 20/59* (2013.01); *G08B 5/36* (2013.01)

(58) Field of Classification Search
CPC .. F41H 5/08; G08B 5/226; G08B 7/06; G08B 27/001; G08B 5/36; H04H 20/59
See application file for complete search history.

(56) References Cited

U.S. PATENT DOCUMENTS

| | | | | |
|---|---|---|---|---|
| 6,111,522 | A * | 8/2000 | Hiltz | G07F 7/0866 705/418 |
| 7,980,720 | B2 * | 7/2011 | Shemwell | F41H 13/0018 362/114 |
| 8,403,106 | B2 * | 3/2013 | Bostick | F41H 5/08 181/142 |
| 8,850,949 | B1 * | 10/2014 | Lopez | F41H 5/24 89/36.02 |
| 9,224,358 | B2 * | 12/2015 | Drake | G06Q 30/0625 |
| 10,619,978 | B1 * | 4/2020 | Ackley | F41H 5/02 |
| 2007/0125224 | A1 * | 6/2007 | Thomas | F41H 5/08 89/36.07 |
| 2011/0235467 | A1 * | 9/2011 | Bostick | F41H 13/0081 367/139 |
| 2012/0091950 | A1 * | 4/2012 | Campanella | H02J 50/90 320/108 |
| 2013/0120163 | A1 * | 5/2013 | Kollakowski | B64D 45/00 340/945 |
| 2013/0262078 | A1 * | 10/2013 | Gleadall | G06F 40/47 704/3 |
| 2014/0232616 | A1 * | 8/2014 | Drake | G06Q 30/0639 345/1.2 |
| 2014/0320739 | A1 * | 10/2014 | Collier | H04N 21/4143 348/383 |
| 2017/0322761 | A1 * | 11/2017 | Marcus | G06F 1/1647 |
| 2020/0021666 | A1 * | 1/2020 | Wojcik | H04L 67/18 |
| 2022/0018170 | A1 * | 1/2022 | Rush | F41H 5/08 |

* cited by examiner

*Primary Examiner* — Nay Tun

(57) ABSTRACT

A portable shield includes a protective shield and a handle attached to the protective shield for holding and carrying the portable shield from a first side of the protective shield. The portable shield further includes a battery and a display element powered by the battery. The display is configured for electronically displaying an instructional message that is visible from a second side of the protective shield at a distance, wherein the second side is opposite the first side. The portable shield further includes electronic circuitry powered by the battery that is configured for selectively displaying the instructional message on the display element. In some examples, the portable shield may wirelessly receive information regarding the instructional message from a base station along with other instances of the portable shield.

19 Claims, 9 Drawing Sheets

PROTECTIVE SHIELD WITH DISPLAY

FIELD

This application relates to apparatuses for safety, crowd control, and riot control.

BACKGROUND

Various types of devices and equipment are used by law enforcement or other authorities when conducting law enforcement, crowd control, and/or riot control activities. These situations often involve large numbers of people and unexpected or changing circumstances. Because these are not typically planned situations, law enforcement or other authorities must often determine their response or course of action on a real-time basis, or near real-time basis. Consequently, law enforcement frequently must attempt to communicate instructions or requests to groups or crowds of people while these situations are unfolding. The nature of these situations is such that there is often noise, darkness, confusion, chaos, violence, frustration, anger, smoke, and/or fire. These factors can make it even more difficult to communicate with crowds and often inhibit the effectiveness of communicating instructions or requests over audio loudspeakers. In addition, the nature of these situations is such that the location of the interaction is often unpredictable, moving, and/or changing. Improved methods of communicating to groups or crowds of people in law enforcement, crowd control, and/or riot control situations are needed.

SUMMARY

A portable riot shield includes a protective shield and a handle attached to the protective shield for holding and carrying the portable riot shield from a first side of the protective shield. The portable riot shield further includes a battery and a display element powered by the battery. The display is configured for electronically displaying an instructional message that is visible from a second side of the protective shield at a distance, wherein the second side is opposite the first side. The portable riot shield further includes electronic circuitry powered by the battery that is configured for selectively displaying the instructional message on the display element. In some examples, the portable riot shield may wirelessly receive information regarding or including the instructional message from a base station.

Various improvements are disclosed herein in the form of apparatuses, devices, components, systems, and methods. In some situations, improvements may include features implemented as non-transitory machine-executable computer instructions that may be executed by one or more computer processors to perform one or more of the improvements disclosed herein or to perform a portion of one or more of the improvements disclosed herein.

BRIEF DESCRIPTIONS OF DRAWINGS

DETAILED DESCRIPTION

A protective shield or riot shield is a portable, lightweight protection device often used by law enforcement and military. Riot shields are often long enough to cover a person from the top of the head to the knees, although smaller ones are possible. Riot shields are generally intended to be used in riot control, crowd control, and/or civil disturbances. They may be used to block thrown projectiles, blunt objects, knives, fists, rocks, small explosives, and may also be used to push people or objects. Riot shields are often constructed from transparent polycarbonate to enable the user to see through it. Riot shields may also be constructed primarily of a non-transparent material and include a smaller window or viewing area. Riot shields often include one or more handles enabling the user to easily carry and position it. While many of the examples herein are explained with respective to a riot shield, the improvements disclosed herein are equally applicable to any type of portable protective shield, screen, or barrier.

Figure 1:
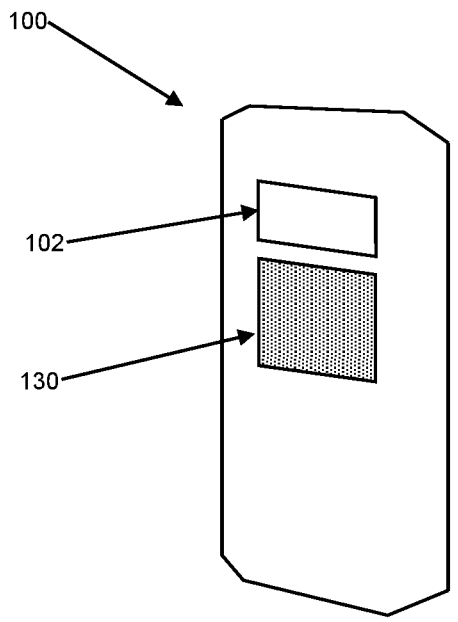
FIG. 1 illustrates a protective shield having an information display.

FIG. 1 illustrates a portable protective shield 100. Protective shield 100 may be primarily made up of a material chosen to resist or protect the user from thrown objects, projectiles, blunt objects, knives, fists, rocks, explosive blasts, and/or liquids. Many shapes, sizes, and configurations of protective shield 100 are possible. Protective shield 100 includes a viewing window 102 which allows the user to see forward while still being protected. Viewing window 102 may be covered with a transparent, or substantially transparent material such as polycarbonate or LEXAN. Alternately, viewing window 102 may be covered with a rugged screen or mesh material that provides protection from larger objects but still permits the user to see through relatively well.

Protective shield 100 also includes an information display 130 for displaying instructional messages to one or more people standing opposite the user or holder of protective shield 100. Display 130 comprises one or more devices for visually displaying information and may include one or more of a light emitting diode (LED), an organic light emitting diode (OLED), a liquid crystal display (LCD), electronic paper, electrophoretic ink, and/or another type of device for visually conveying information, including combinations thereof. Display 130 may be made up of a group of discrete display elements, such as a group of LEDs. Display 130 may also be made up of a single display device, such as an LCD, containing a plurality of display elements, segments, or areas. Display 130 may be illuminated in a variety of combinations, sequences, colors, patterns, and/or intensities to convey various information. Display 130 may include a protective covering or may be covered with a transparent protective covering to protect display 130 from damaging forces which may be experienced in the use of a protective shield.

Figure 2:
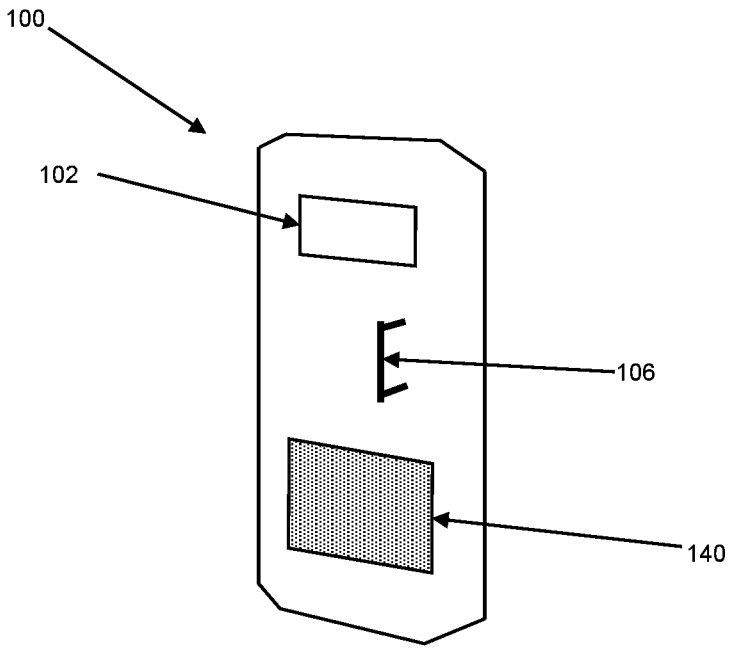
FIG. 2 illustrates an opposite side of the protective shield of FIG. 1.
Figure 3:
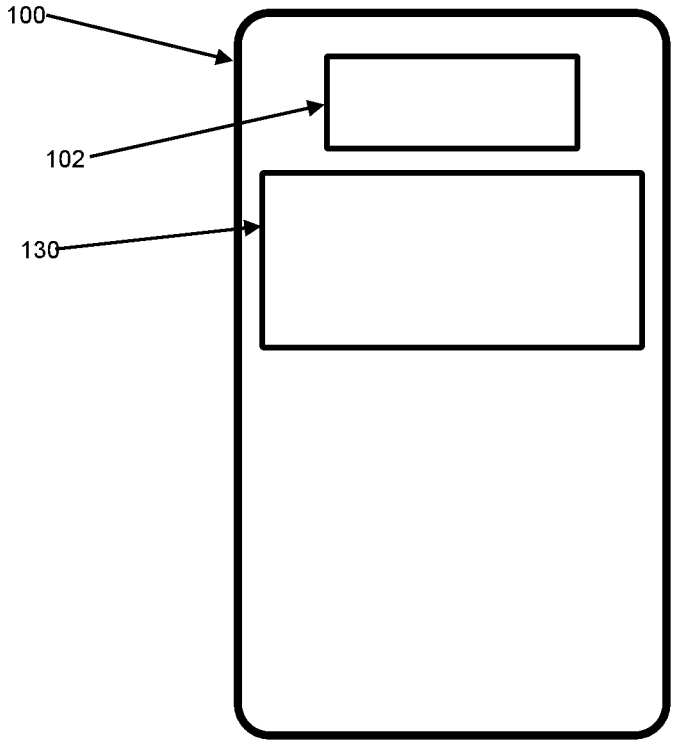
FIG. 3 illustrates a diagram of a protective shield.

FIG. 2 illustrates protective shield 100 of FIG. 1 from an opposite side. Protective shield 100 includes a handle 106 for a user to carry and manipulate protective shield 100. Other types and quantities of handles or holders are possible. Protective shield 100 also includes electronics 140 which are discussed in more detail below. FIG. 3 illustrates a block diagram of protective shield 100. Protective shield 100 may also include a shoulder support, a waist attachment, or one or more other mechanisms for supporting or holding protective shield 100 on the body.

Figure 4:
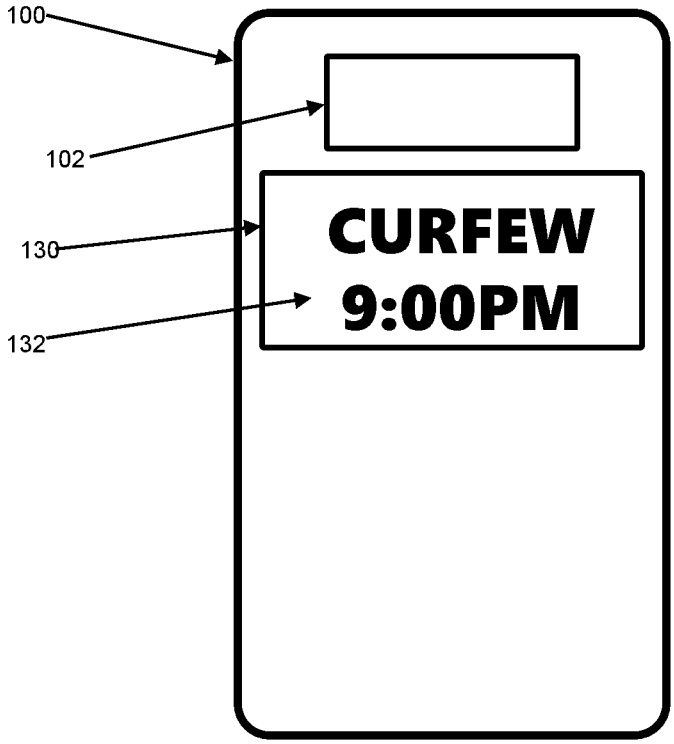
FIG. 4 illustrates the protective shield of FIG. 3 with a message displayed.

FIG. 4 illustrates protective shield 100 with an instructional message 132 displayed on display 130. Since display 130 is an electronic or changeable display, instructional message 132 may be selectively displayed, updated, changed, or turned off as needed, or as circumstances change. Since instructional message 132 is displayed visually it may be more effective, or incrementally effective, to audio announcements in situations where there is a lot of noise, commotion, or chaos. Crowds may not be able to hear or understand information or instructions be transmitted over a loudspeaker. Visual information displayed for longer periods of time may be more effective.

It may also be easier for law enforcement or other authorities to communicate requests or directions to crowds of people in chaotic situations through visual messages. In addition, instructional message 132 may be cycled between two or more languages. Further, since instructional message 132 is included on portable protective shield 100 it will typically move along with the center of the activity or crowd control efforts because it is kept with the authorities who are managing the activity. In contrast, loudspeakers or public address systems may be on vehicles, which are not necessarily moved, or easily moved, as crowd situations migrate. Instructional message 132 may be coordinate or synchronized with traditional audio instructions or announcements, and/or with text messages, social media updates, or other electronic communications. In addition, an instructional message may be time coordinated. For example, the instructional message may indicate that "Curfew Starts in 20 Minutes" and this message may automatically countdown and be updated based on the current time without manual changing of the message.

Figure 5:
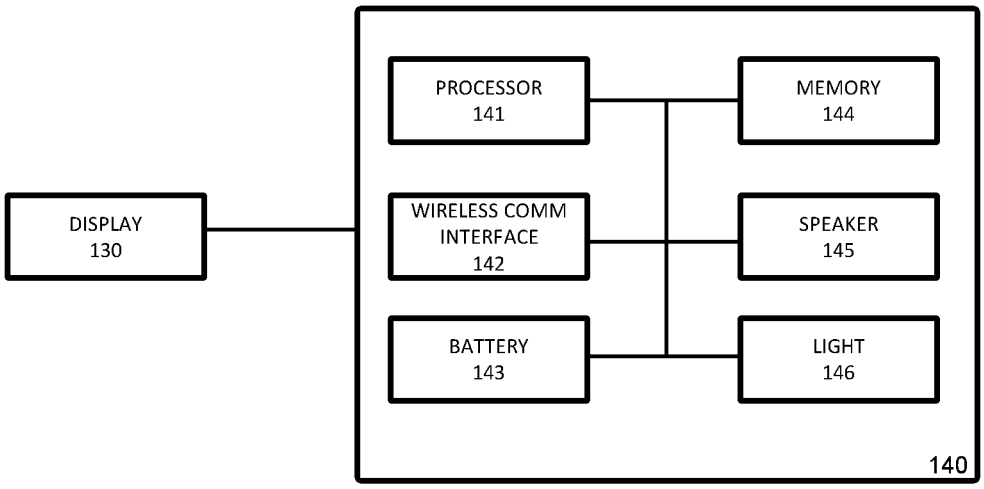
FIG. 5 illustrates a block diagram of electrical components of the protective shield of FIG. 3.

FIG. 5 illustrates a block diagram of electronics 140. Electronics 140 may include any of processor 141, wireless communications interface 142, battery 143, memory 144, speaker 145, and light 146. Electronics 140 may also contain other components such as a printed circuit board, other electrical components, discrete components, electrical circuitry, analog components, digital components, a voltage controller, a voltage booster, a current limiter, a battery charge controller, a battery monitor, electromechanical connectors, an electrical coil, a button, a switch, an inductive electrical coil, a global positioning system (GPS) device, a housing, a display controller, a fan, and/or other components. Electronics 140 may also include software, firmware, or other processor executable instructions, including non-transient instructions.

Processor 141 may include any type of microcontroller, microprocessor, microcomputer, programmable logic device, reconfigurable circuit, digital signal processor, or application specific circuit that is configured to control, operate, and/or communicate with other elements of elements of protective shield 100 or with other systems as described in further detail below. Processor 141 may control or operate any of the elements or components of protective shield 100 including controlling the display of instructional messages on display 130. Memory 144 may be any type of electronic data memory such as RAM, ROM EPROM, EEPROM, and/or flash memory for storing information electronically, including both transient and non-transient memory technologies.

Battery 143 may be configured for supplying electrical power to one or more of the electrical components and/or display 130. Battery 143 may comprise one or more of a variety of electrical power storage technologies including lithium ion (Li-ion), lithium ion polymer (Li-ion polymer), lead-acid, nickel cadmium (NiCd), nickel metal hydride (NiMH), nickel-zinc, alkaline, fuel cells, lithium titanate cells, capacitive energy storage devices, super capacitors, and/or any other type of device for storing energy. Battery 143 may be a rechargeable battery and/or a removable or swappable battery. While the term "battery" is primarily used herein for purposes of explanation, the apparatuses, methods, systems, and techniques described herein are applicable for use with any power or energy storage technology. The apparatuses, methods, and techniques described herein are not to be limited to any particular type of battery or energy storage technology.

Wireless communication interface 142 may include any device or combination of devices for enabling wireless communication between protective shield 100 or electronics 140 and one or more other devices. The wireless communication, if any, may be compatible with one or more wireless communication standards, or industry standards, such as WIFI, BLUETOOTH, BLUETOOTH LOW ENERGY, NFC, ZIGBEE, and/or any other wireless communication standard, such as a cellular wireless communication standard. Wireless communication may also be conducted using optical or infrared communication methods. Wireless communication may also be conducted using a proprietary format, system, or protocol. The wireless communication may include simplex, half-duplex, and/or full duplex communication. Wireless communication interface 142 may include components such as a modulator, a demodulator, an rf transmitter, an rf receiver, an antenna, optical components, a filter, a mixer, and/or an amplifier.

Electronics 140 may also include a speaker 145, such as a loudspeaker. Electronics 140 may also include a light 146, such as a floodlight. Electronics 140 may also include or interface to a non-lethal weapon such as a pepper spray dispenser or a flash bang detonator.

Figure 6:
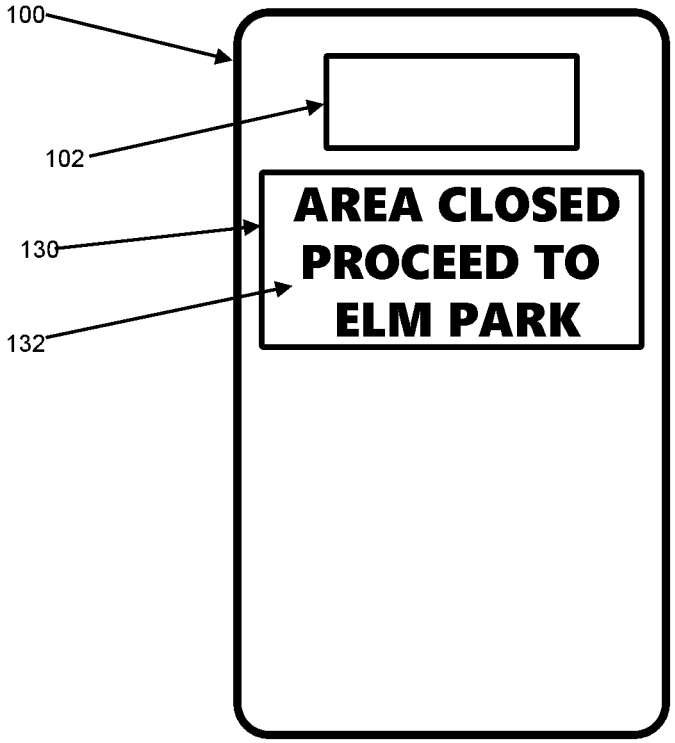
FIG. 6 illustrates the protective shield of FIG. 3 with a different message displayed.

FIG. 6 illustrates an example in which an updated instructional message 132 is displayed on display 130 of protective shield 100. While the prior message may have been the message displayed in FIG. 4, the instructional message 132 in FIG. 6 can quickly be changed or updated to meeting changing needs, circumstances, or locations. In addition, display 130 may toggle or cycle between two or more different instructional messages. The desired or needed message may change as a situation unfolds or as a crowd control effort progresses to different parts of a city.

Figure 7:
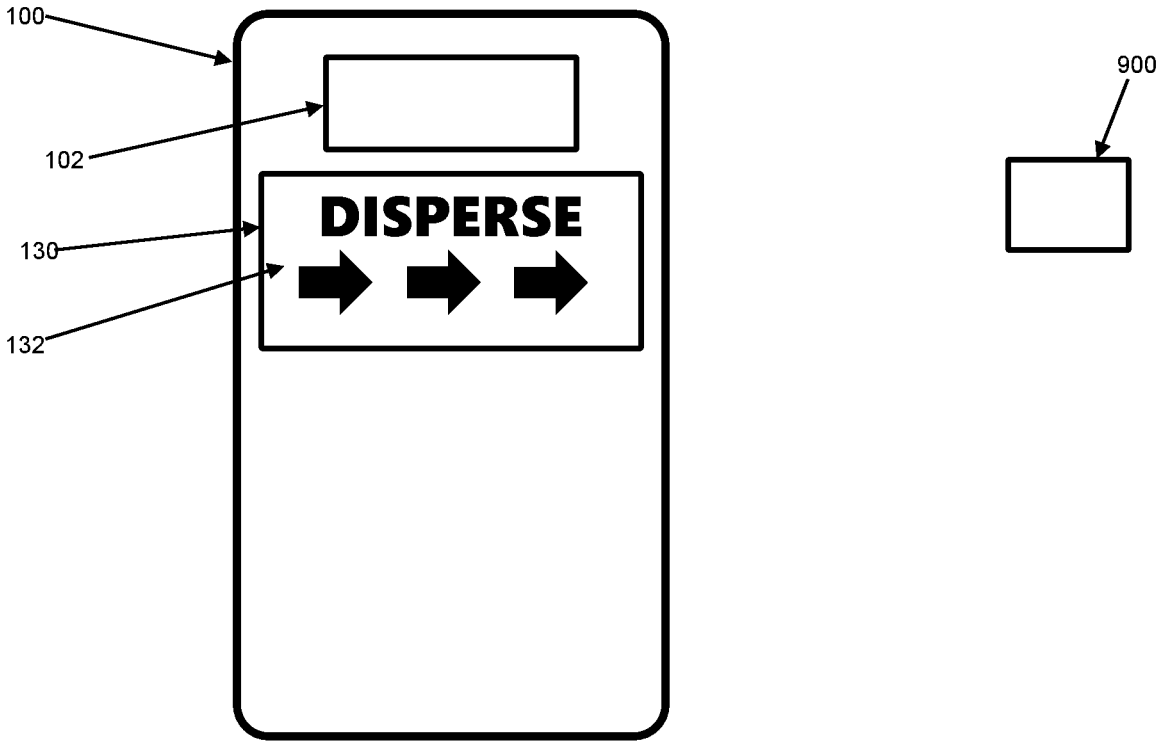
FIG. 7 illustrates a protective shield system.

FIG. 7 illustrates a protective shield system which includes protective shield 100 and a base station 900. Base station 900 may be any type of electronic or computerized system capable of electronic data communication with protective shield 100, such as through wireless communication interface 142. Base station 900 may send control messages to protective shield 100 which include instructions on what instructional message should be displayed on display 130 of protective shield 100. The instructions may include information about the instructional message content, text, symbols, text size, language, display time, brightness, sequencing or toggling between multiple messages, and the like. In this way, a management authority at or using base station 900 can easily and remotely control or change the information being displayed on protective shield 100. In this way, the response to updated or changing crowd or riot control plans can be implemented without having to physically access protective shield 100 and/or without directly communicating with the user of protective shield 100.

Base station 900 may include software or firmware allowing the supervisor or managing authority to select from "canned" messages or to create custom messages. In addition, control messages sent from base station 900 to protective shield 100 may include audio information to be played on speaker 145. The audio information may duplicate or may supplement the information to be displayed on display 130. In addition, base station 900 may control other features of protective shield 100, such as light 146.

Figure 8:
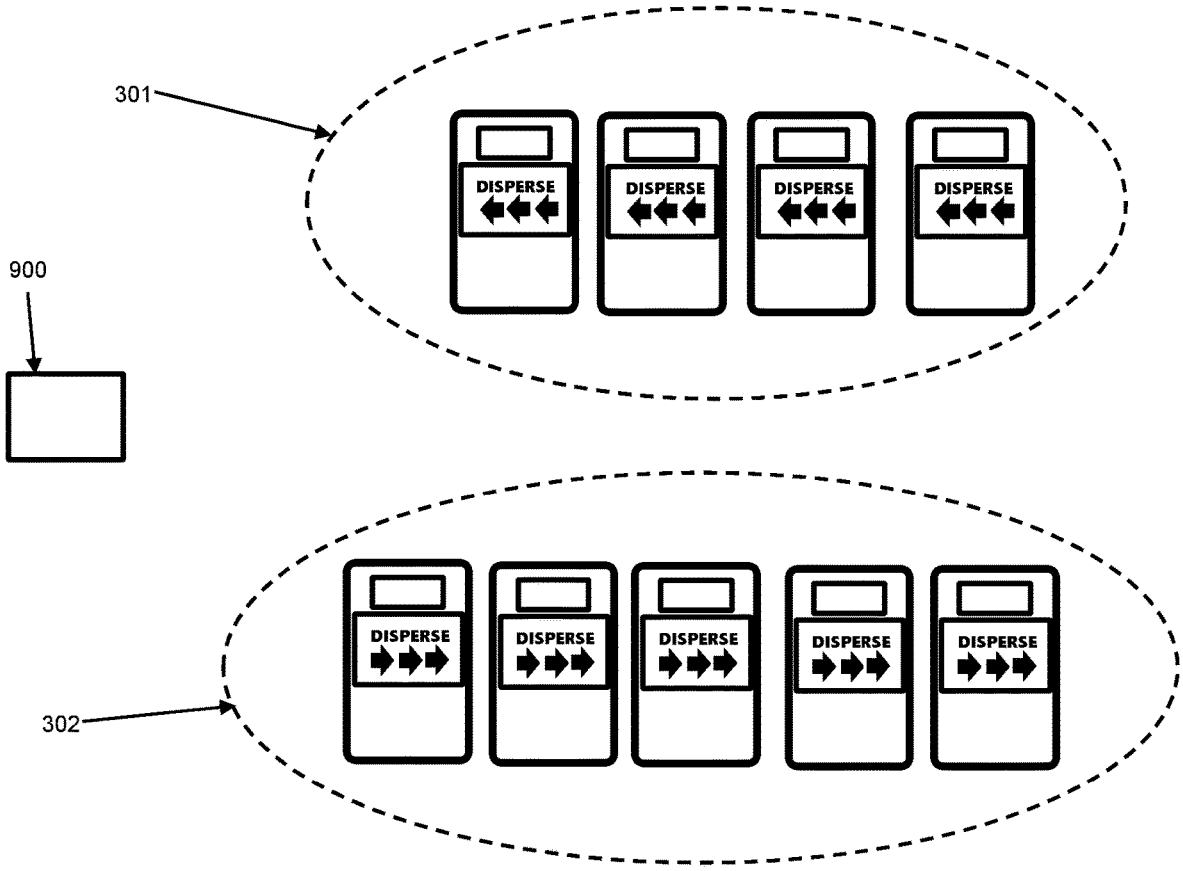
FIG. 8 illustrates a protective shield system with two groups of protective shields.

FIG. 8 illustrates a protective shield system in which base station 900 is controlling displays of a plurality of protective shields 100. The plurality of protective shields 100 are divided into two groups, first subset 301 of the plurality of protective shields and second subset 302 of the plurality of shields. Each of the protective shields may include a unique identifier or serial number such that each can be individually identified, addressed, and/or controlled. Any number of subsets may be created and any number of protective shields may be included in any subset. The protective shields may be dynamically assigned or reassigned to subsets on a real-time basis.

By assigning the protective shields to groups or subsets, base station 900 may control or operate them independently. In one example, a first instructional message is sent to be displayed on the protective shields of first subset 301, while a second instructional message that is different than the first is sent to be displayed on the protective shields of second subset 302. The subsets may be selected or defined based on a variety of criteria including location, direction of movement, organization, identity of the user, language of the user, training level of the user, and/or reporting authority of the user.

In the example of FIG. 8, the protective shields of subset 301 are commanded by base station 900 to display an instructional message indicating that a crowd is to disperse in an indicated direction. At the same time, the protective shields of subset 302 are commanded by base station 900 to display a instructional message indicating that another part of the crowd is to disperse in a different direction. This approach may be chosen because subset 301 and subset 302 are at different locations or on opposite sides of a crowd, riot, or protest and authorities wish to move different parts of the crowd in different directions away from a central point. In this way, the commanding authority can quickly deliver clear instructions to different areas via base station 900 without having to directly communicate with a supervisor associated with subset 301 or 302 and without having to provide these crowd control instructions to individual users of the protective shields.

While displaying the differing messages indicated in FIG. 8, both subsets 301 and 302 may also be commanded to alternate or toggle between the illustrated messages and a common message, such as that illustrated in FIG. 4. Beneficially, the instructional messages can quickly be changed or updated as situations, circumstances, or locations change. Further, the text, arrow, and any other displayed elements may be animated, flash, or scroll across display 130 for improved clarity or attention. In some examples, longer messages may scroll across display 130. In other examples, display 130 may be a multi-color display that displays different portions of the instructional messages in different colors.

Protective shield 100 may include location determination circuitry, such as a GPS receiver, and may communicate determined location information to base station 900. This information may be used to assign or reassign a protective shield to subset 301, subset 302, and/or to a different subset. In this way, instructional messages will be automatically coordinated based on the changing location or position of a particular officer or user. Protective shield 100 may also transmit other status or operational information to base station 900.

In other examples, a single protective shield in a particular subset may be identified or selected to be a master or control for the subset. In this configuration, all the other protective shields in a subset may receive their commands or instructions from this master protective shield and the master protective shield may be the only one in direct communication with base station 900.

In some examples, protective shield 100 may also include a user facing display which shows the user the information being displayed on the opposite side of display 130. A control panel may be included in or near the inward facing display to allow the user to control other features or functions of protective shield 100, monitor a status of protective shield 100, and/or send information to base station 900. In some examples, an individual user or carrier of protective shield 100 may be able to manually or individually input, change, modify, toggle, activate, and/or deactivate the instructional message being displayed on his or her protective shield. In some examples, the communications between base station 900 and protective shield 100 may also include audio communications to the users. In other words, some or all of the functions of conventional 2-way radios may be integrated into the systems and communications disclosed herein. An officer may plug a headset into protective shield 100 for these communications rather than carrying a radio separately.

Figure 9:
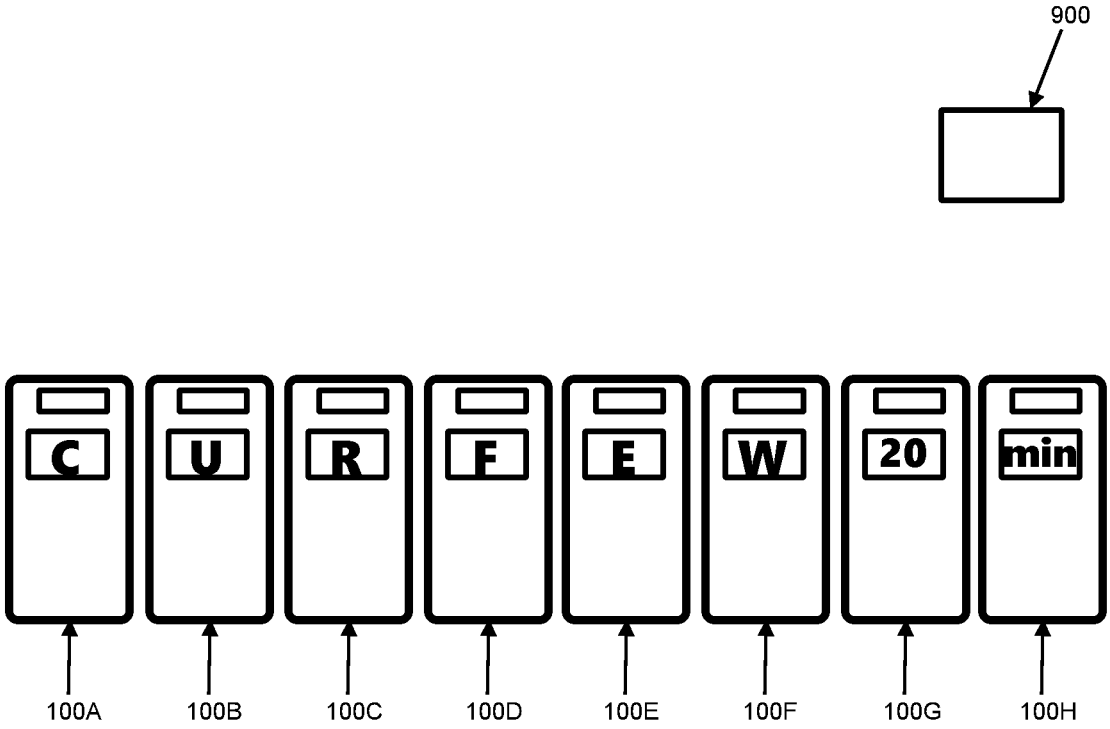
FIG. 9 illustrates a protective shield system with a distributed message.

FIG. 9 illustrates the protective shield system of FIG. 8 with a distributed instructional message being displayed on at least one of the subsets of the protective shields. As directed by base station 900, and in response to wireless command messages received from base station 900, protective shields 100A-100H each display a unique portion of a larger instructional message. In this way, the instructional message can be displayed in larger font or characters for visibility purposes. As in other examples, this distributed instructional messages may be animated, flash, scroll, toggle between languages, or have other dynamic characteristics. At the same time, different instructional messages, distributed and non-distributed, may be displayed on other subsets of protective shields controller by base station 900. In this example, base station 900 may send different command or control messages to each protective shield within a group or subset in order to generate a message as illustrated. Alternately, base station 900 may send a same command or control message to all of the protective shields where the message includes individual commands or instructions for each protective shield.

As described above, GPS and/or other location determination devices may be used for determining a location of protective shield 100 for purposes of determining what instructional message should be displayed and/or which subset or group it should be included with. In the example of FIG. 9 even more precise location determination may be needed to determine locations precise enough to get the illustrated lettering in the correct order. Each of protective shield 100A-H may include additional location determination circuitry which interact with each other to determine their relative positions. In other words, protective shields 100A-H may communicate with each other or sense each other such they can gather information regarding which one is to the left, the right, in front, or in back of each other. This information is transmitted to base station 900 so that base station can determine the current order of protective shields 100A-H such that each can be commanded to display the proper letter or information to produce a desired message. This location or order determination may automatically occur on an ongoing or periodic basis such that the letters will automatically be corrected if two or more users end up changing positions.

Battery 143 may be removable or replaceable such that it can easily be replaced with a newly charged battery. In other examples, protective shield 100 may be recharged with battery 143 in place. Any of the systems disclosed herein may include a battery charging bank or dock for electrically interfacing to multiple instances of battery 143 and/or multiple instances of protective shield 100 for recharging.

While many of the examples herein are described with respect to shields that are carried, the improvements disclosed herein may also be implemented in other apparatuses that are used for crowd control, crowd management, traffic management, and/or riot control. For example, the improvements disclosed herein may be implemented in portable barriers, temporary signs, fence panels, traffic signs, and security barriers.

Any combination of the devices, apparatuses, and/or software disclosed herein may be configured in the form of a system or kit.

Some or all of the steps and operations associated with the techniques introduced here may be performed by hardware components or may be embodied in non-transitory machine-executable instructions that cause one or more computer processors programmed with the instructions to perform the steps. Alternatively, the steps may be performed by a combination of hardware, software, and/or firmware.

The apparatuses, systems, methods, techniques, and components described herein are meant to exemplify some types of possibilities. In no way should the aforementioned examples limit the scope of the invention, as they are only exemplary embodiments.

The foregoing disclosure has been presented for purposes of illustration and description. Other modifications and variations may be possible in view of the above teachings. The examples described in the foregoing disclosure were chosen to explain the principles of the concept and its practical application to enable others skilled in the art to best utilize the invention. It is intended that the claims be construed to include other alternative embodiments of the invention except as limited by the prior art.

The phrases "in some embodiments," "according to some embodiments," "in the embodiments shown," "in other embodiments," "in some examples," "in some cases," "in some situations," "in one configuration," "in another configuration" and the like generally mean that the particular feature, structure, or characteristic following the phrase is included in at least one embodiment of the present invention and/or may be included in more than one embodiment of the present invention. In addition, such phrases do not necessarily refer to the same embodiments or different embodiments.

What is claimed is:

1. A portable riot shield comprising:

a protective shield;

a handle attached to the protective shield, wherein the handle is configured for holding and carrying the portable riot shield from a first side of the protective shield;

a battery;

electrical circuitry powered by the battery;

a display element powered by the battery and configured for electronically displaying an instructional message when directed by the electrical circuitry, wherein the displayed instructional message is visible from a second side of the protective shield at a distance, wherein the second side is opposite the first side, and wherein the electrical circuitry and the display element are configured to operate while the portable riot shield is being carried; and a second display element powered by the battery and configured for displaying the instructional message on the first side of the protective shield to a holder of the portable riot shield.

2. The portable riot shield of claim 1 wherein the electronic circuitry includes a wireless transceiver configured for wirelessly receiving electronic messages from a base station, wherein the electronic message includes one or more of an instruction to display the instructional message and an updated instructional message.

3. The portable riot shield of claim 2 wherein the electronic circuitry is further configured to execute instructions provided by the base station in the electronic messages.

4. The portable riot shield of claim 3 wherein the portable riot shield has unique identifier and is configured to parse the electronic messages from the base station, based on the unique identifier, to identify instructions which are specifically directed to the portable riot shield.

5. The portable riot shield of claim 2 wherein the wireless transceiver is further configured for wirelessly exchanging electronic messages with one or more other instances of the portable riot shield.

6. The portable riot shield of claim 1 wherein the displayed instructional message includes both text and graphics.

7. The portable riot shield of claim 1 wherein the display element is configured for scrolling messages across the display element.

8. The portable riot shield of claim 1 wherein the electronic circuitry further includes global positioning circuitry for determining a location of the portable riot shield.

9. The portable riot shield of claim 8 wherein instructional message is updated based on the location of the portable riot shield.

10. A protective shield system comprising:

a base station configured for wirelessly transmitting a plurality of unique control messages; and a plurality of protective shields each comprising:

a shield member;

a handle attached to the shield member, wherein the handle is configured for holding and carrying the protective shield from a first side of the protective shield;

a rechargeable battery;

a display element powered by the battery and configured for electronically displaying information visible at a distance from a second side of the protective shield opposite the first side;

global positioning circuitry for determining a location of the protective shield; and electronic circuitry powered by the battery and configured for:

wirelessly transmitting a status message to the base station, wherein the status message includes the location of the protective shield determined by the global positioning circuitry;

wirelessly receiving the control messages from the base station, wherein each control message includes a unique instructional message generated by the base station based on the location of one of the protective shields; and selectively displaying the received instructional message on the display element.

11. The protective shield system of claim 10 wherein each of the plurality of protective shields includes a unique identifier and the base station is further configured to send a first control message to a first subset of the plurality of protective shields and to send a second control message that is different than the first control message to a second subset of the plurality of protective shields that is different than the first subset of the plurality of protective shields.

12. The protective shield system of claim 10 wherein the electronic circuitry of one of the protective shields is further configured for functioning as a master protective shield which is in direct communication with the base station and in direct communication with the other of the plurality of the protective shields, wherein the other of the plurality of the protective shields are not in direct communication with the base station and receive the control messages from the master protective shield.

13. The protective shield system of claim 12 wherein the status message includes information input by a user of the protective shield.

14. The protective shield system of claim 10 wherein the electronic circuitry of each protective shield includes circuitry for determining a direction of movement of the protective shield, and wherein the status message includes the direction of movement of the protective shield.

15. The protective shield system of claim 14 wherein the protective shields are each assigned to one of the first subset and the second subset of the plurality of protective shields based, at least in part, on the respective status messages.

16. The protective shield system of claim 14 wherein differing portions of the instructional message are simultaneously displayed by the first subset and the second subset of the protective shields.

17. The protective shield system of claim 10 wherein each protective shield includes an audio speaker configured for transmitting audio information received in one or more of the control messages.

18. The protective shield system of claim 10 wherein the instructional message displayed on the display element is repeatedly alternated between two languages.

19. The protective shield system of claim 10 further comprising a charging hub for simultaneously recharging the batteries of two or more of the protective shields.

* * * * *